US006869649B2

(12) United States Patent
Sen

(10) Patent No.: US 6,869,649 B2
(45) Date of Patent: Mar. 22, 2005

(54) PRINT MEDIUM INCLUDING A HEAT-SEALABLE LAYER

(75) Inventor: Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 91 days.

(21) Appl. No.: 10/387,661

(22) Filed: Mar. 12, 2003

(65) Prior Publication Data

US 2004/0180151 A1 Sep. 16, 2004

(51) Int. Cl.[7] ..... B41M 5/40
(52) U.S. Cl. ..... 428/32.35; 428/32.25; 428/32.37
(58) Field of Search ..... 428/32.25, 32.35, 428/32.37, 32.36

(56) References Cited

U.S. PATENT DOCUMENTS

2004/0090512 A1 * 5/2004 Yau et al. ..... 347/105
2004/0090514 A1 * 5/2004 Yau et al. ..... 347/106
2004/0109957 A1 * 6/2004 Sen ..... 428/32.1

FOREIGN PATENT DOCUMENTS

| | | |
|---|---|---|
| EP | 0858905 | 8/1998 |
| WO | WO 00/72984 | 12/2000 |

* cited by examiner

*Primary Examiner*—B. Shewareged

(57) ABSTRACT

A print medium having a heat-sealable layer comprised of a first component and a second component. The first component and the second component have different particle sizes and different glass transition temperatures. A method of producing the print medium is also disclosed. The print medium is used to produce a photographic-quality image by applying inkjet ink to the print medium. The heat-sealable layer of the print medium is sealed by exposing the layer to a temperature above the glass transition temperatures of the two components. An inkjet printer used to apply inkjet ink to the print medium may include a radiant heater.

12 Claims, 14 Drawing Sheets

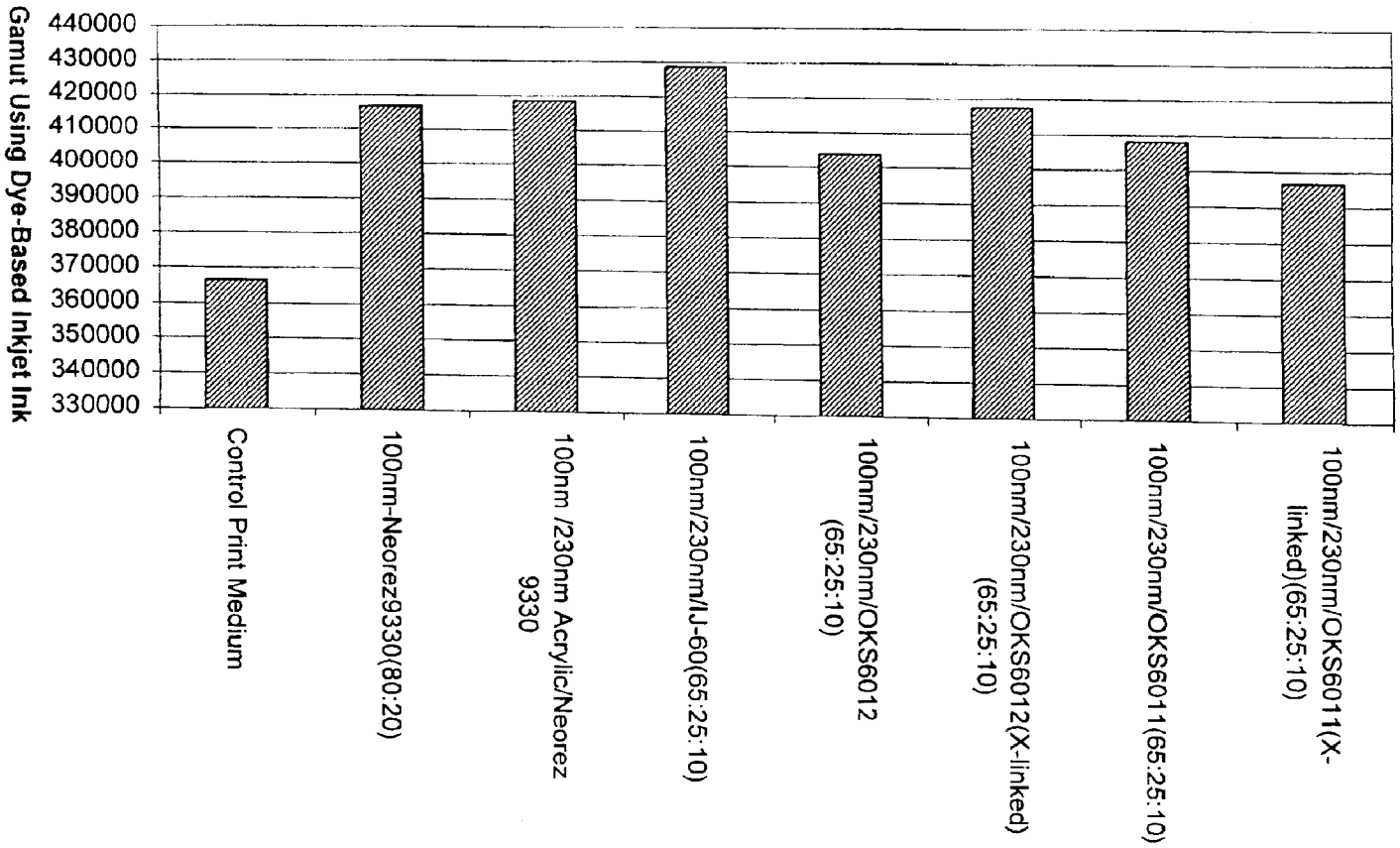
FIG. 4: Color Gamut of Cationic, Heat-Sealable Formulations Coated Over Alumina Microporous Ink-Receiving Layers

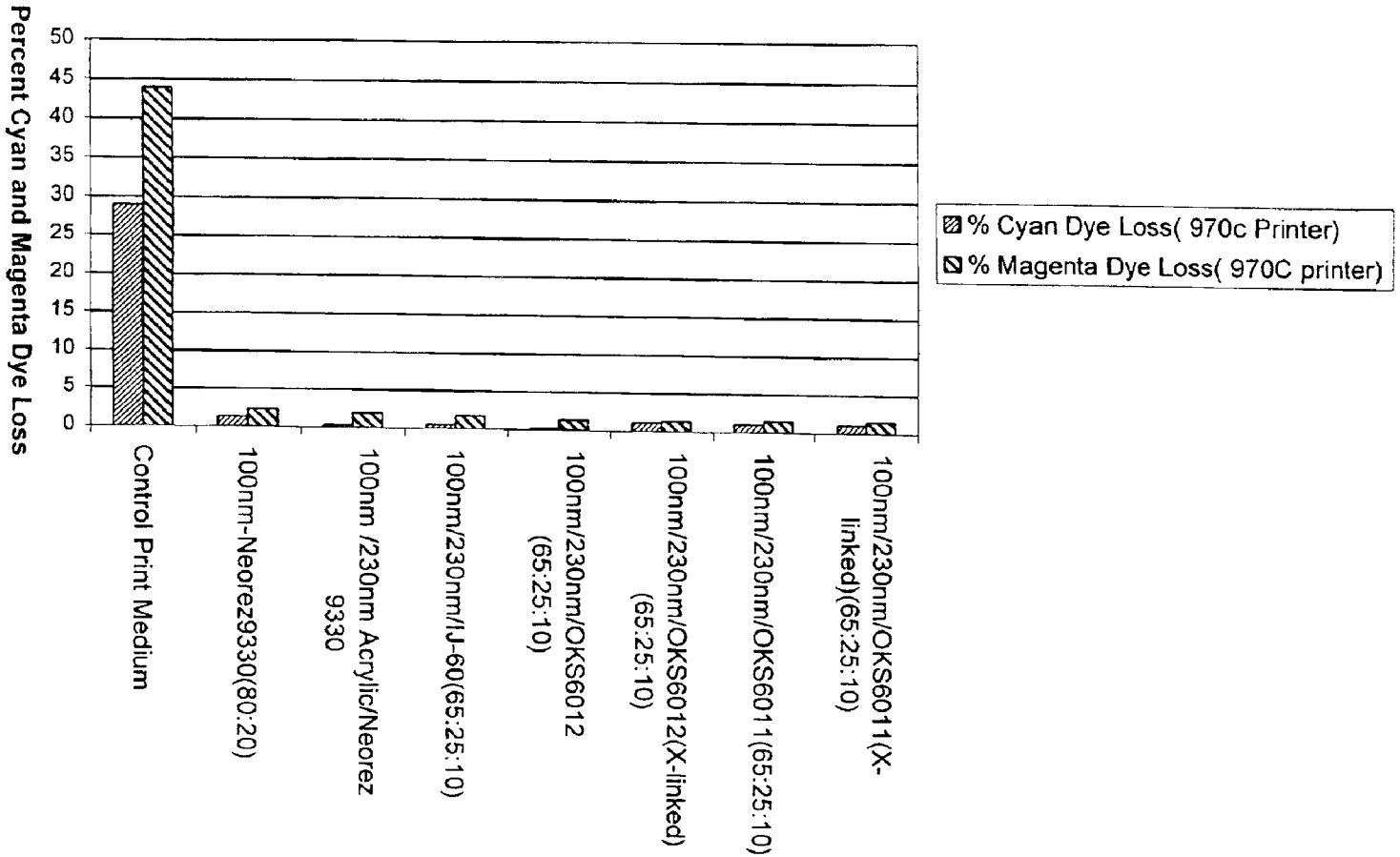
FIG. 5: Percent Cyan and Magenta Dye Loss Due to Airfade After 4 weeks in Air Fade Chamber.

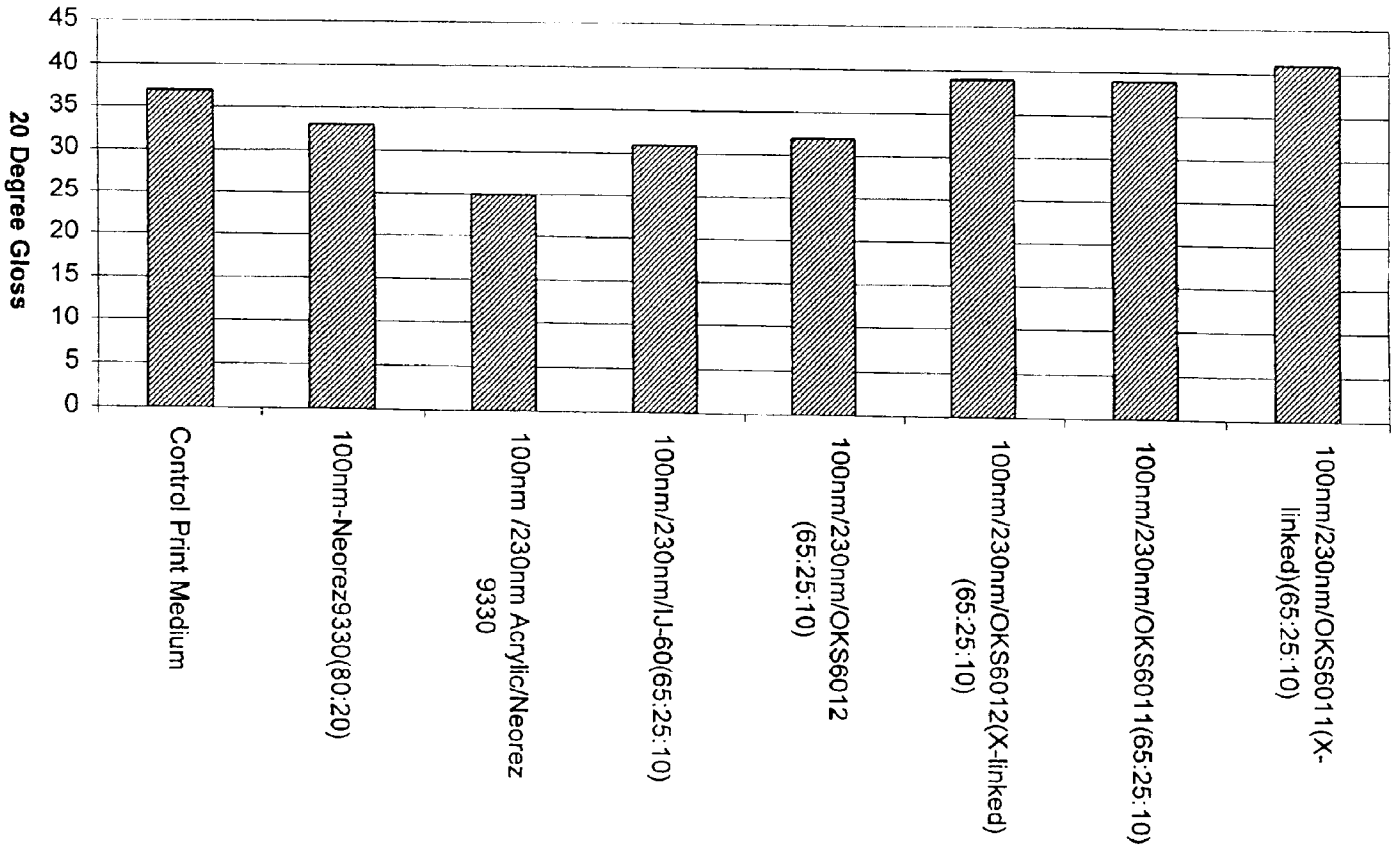
FIG. 6: 20 Degree Celsius Unprinted Gloss of Cationic, Heat-Sealable Formulations FIG. 7: Maximum Printed Gloss for Cationic, Heat-Sealable Formulations
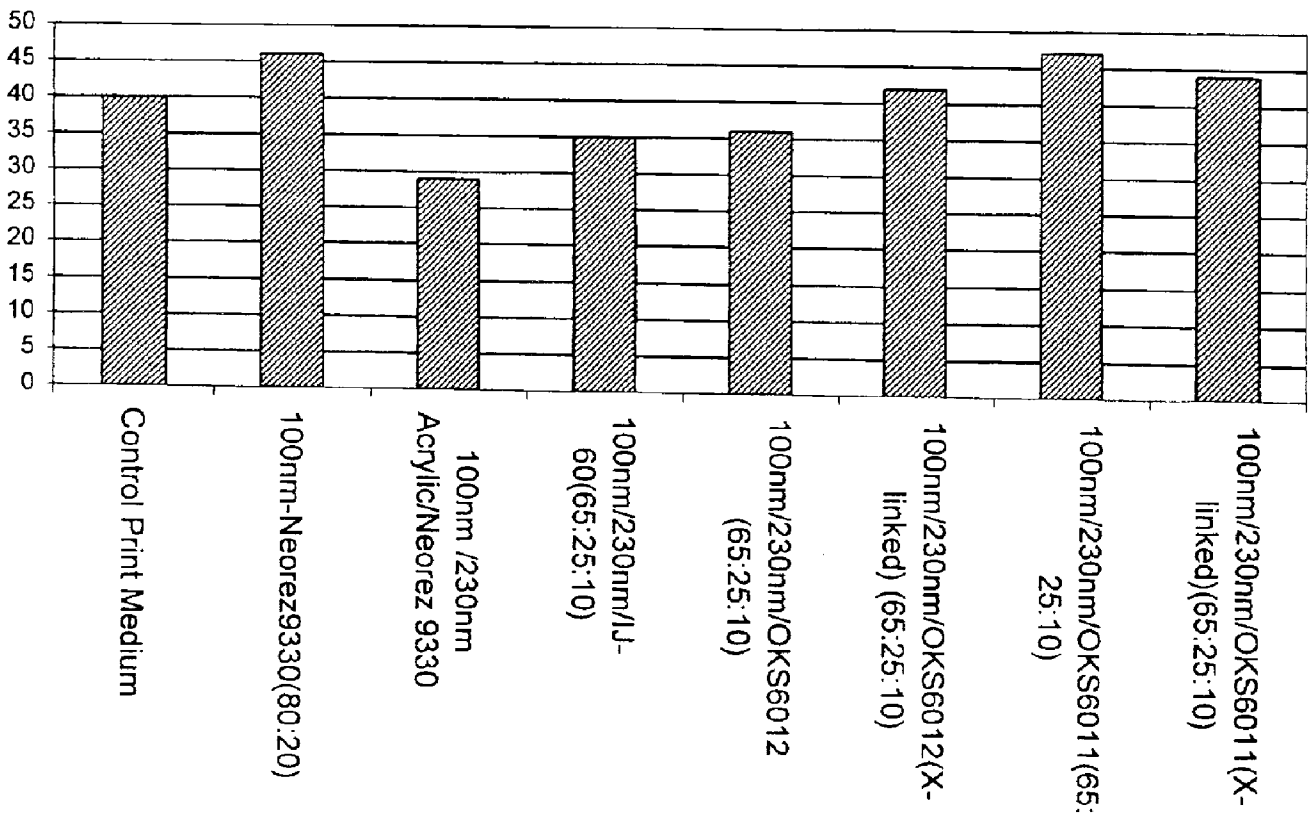

PRINT MEDIUM INCLUDING A HEAT-SEALABLE LAYER

BACKGROUND OF THE INVENTION

With the advent of high speed inkjet printing, dry times of printed images have become an important issue because the inkjet inks must dry quickly in order to prevent smearing of the printed image. To provide fast dry times, microporous inkjet print media have been developed. The microporous inkjet print media use particles or pigments having a large surface area that are held together with a small amount of binder. However, the microporous inkjet print media have poor cohesive strength, which leads to poor scratch resistance. The pores in the microporous inkjet print media also allow substantial airfade of the printed images due to the large surface area that is exposed to air.

In order to obtain printed images that dry quickly and have good image quality, durability, and permanence, microporous inkjet print media with thermally laminated barrier layers have been developed. While lamination of the printed image provides very good image quality and permanence, the cost of producing the laminated images is increased due to the cost of the laminator and the additional supplies that are necessary.

In addition to lamination techniques, the permanence and print quality of printed images have been improved by using a sealable or fusible layer on the print medium. After the desired image is printed, the print medium is exposed to heat and/or pressure to seal the sealable layer over the printed image. The sealable layer forms a film over the printed image, helping to protect the image from scratches or fading. With sealable print medium, the print quality of the image is low until the sealable layer is heated. In other words, photographic resolution is only achieved after the print medium is sealed. Sealable layers are typically formed from a single, small particle size polymeric material having either a low glass transition temperature ("$T_g$") or a high $T_g$. Although these polymeric materials are capable of producing clear films, they are problematic because they shrink when exposed to stresses, unless a large amount of binder is added. However, increasing the amount of binder in the sealable layer compromises the fastness properties. In order to reduce shrinkage, a single, large particle size polymeric material having a high $T_g$ is frequently used. However, using this polymeric material increases the temperature to which the print medium must be exposed to seal the print medium. A heat-sealable print medium that uses a single, large particle size latex having a high $T_g$ can be sealed using a laminator or heated calender type device. The image produced on this print medium, although of acceptable quality after sealing, has shown significant preprint durability issues, which leads to fading in any damaged areas.

Water resistant coatings for use on inkjet printing substrates have also been disclosed. The water resistant coating typically includes plastic pigments of various sizes. Disclosed plastic pigments include styrene polymers, acrylic polymers, or acrylic urethane polymers having particles sizes between 100 and 1500 nm. The water resistant coating provides lightfastness and scratch resistance to printing substrates that are used indoors or outdoors.

Use of a recording medium having a porous outer layer has also been disclosed. The porous outer layer is formed from a thermoplastic resin having a particle diameter of 0.1 $\mu$m to 5 $\mu$m. By exposing the porous outer layer to heat, the porous outer layer is melted to form a nonporous layer.

Images printed on the recording medium have high image density and are resistant to weather.

What is desired is a print medium that is scratch resistant and resistant to airfade. In addition, the print medium should provide good print quality both before and after sealing of the heat-sealable layer so that a user may choose whether to seal the print medium.

BRIEF SUMMARY OF THE INVENTION

A print medium for use in inkjet printing is disclosed. The print medium comprises a heat-sealable layer having a first component and a second component. The first component has a first glass transition temperature and a first particle size and the second component has a second glass transition temperature and a second particle size.

A method of producing a heat-sealable print medium is also disclosed. The method comprises applying a heat-sealable layer having a first component and having a second component to an ink-receiving layer. The first component has a first glass transition temperature and a first particle size and the second component has a second glass transition temperature and a second particle size. The heat-sealable layer is dried at a temperature below the first glass transition temperature and the second glass transition temperature.

A method of producing a photographic-quality image is also disclosed. The method comprises printing inkjet ink on a print medium having a heat-sealable layer comprising a first component and a second component. The first component has a first glass transition temperature and a first particle size and the second component has a second glass transition temperature and a second particle size. A photographic-quality image is formed on the print medium. Subsequently, the heat-sealable layer is sealed to further improve the photographic quality, permanence, and durability of the image.

An inkjet printer having a radiant heater is also disclosed. The radiant heater produces a sufficient energy or heat to seal the heat-sealable layer of the print medium without contacting the print medium. An inkjet printer having a heated device to be applied to the heat-sealable layer is also disclosed. The heated device produces a sufficient energy or heat to seal the heat-sealable layer of the print medium. The heated device is selected from the group consisting of a roller, a platen, a laminator and a calender.

BRIEF DESCRIPTION OF THE SEVERAL VIEWS OF THE DRAWINGS

FIG. 4 graphically illustrates the color gamut observed on the heat-sealable print medium of an embodiment of the present invention;

FIG. 5 graphically illustrates the airfade properties of cyan and magenta inkjet inks printed on the heat-sealable print medium according to an embodiment of the present invention; and FIGS. 6 and 7 graphically illustrate the gloss properties of images printed on the heat-sealable print medium of an embodiment of the present invention.

DETAILED DESCRIPTION OF THE INVENTION

A print medium having good image quality, permanence, and durability is disclosed. The print medium includes a heat-sealable layer having porous polymer particles of different sizes. A first component of the heat-sealable layer has a small particle size and a low $T_g$ and a second component has a large particle size and a high $T_g$. The heat-sealable print medium is used in an inkjet printing process. A desired image is printed on the heat-sealable print medium, resulting in a photographic-quality image. If the heat-sealable layer is subsequently sealed, the image quality is further improved. Therefore, the print medium has good image quality before sealing and very good image quality after sealing. The printed image is also resistant to airfade and scratches.

Figure 1A:
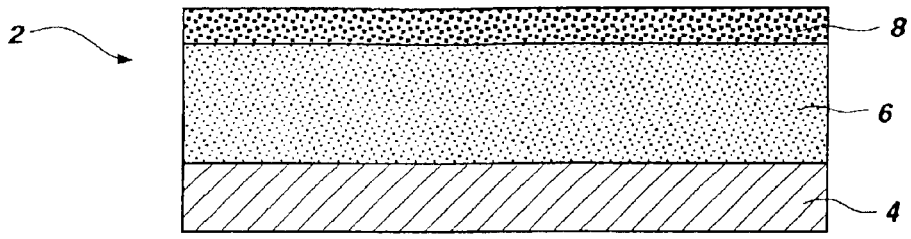
FIGS. 1A–1C illustrates an inkjet printing process using an embodiment of the heat-sealable print medium of the present invention.

The print media may include a substrate layer 4, an ink-receiving layer 6, and the heat-sealable layer 8, as shown in FIG. 1A. The substrate layer 4 may be a conventional photobase or filmbase formed from a transparent, opaque, or translucent material that provides support to the overlying layers as the print media is transported through an ink-jet printer. The substrate layer 4 may include a hard or flexible material made from polymer, paper, glass, ceramic, woven cloth, or non-woven cloth material. Polymers that may be used as the substrate layer 4 include, but are not limited to, polyesters, cellulose esters, polyurethanes, polyester-ethers, polyether ketones, vinyl polymers, polystyrene, polyethylene terephthalate, polysulfones, polybutylene terephthalate, polypropylene, methacrylates, diallyl phthalates, cellophane, acetates, cellulose diacetate, cellulose triacetate, celluloid, polyvinyl chloride, polyvinyl acetate, polycarbonates, and mixtures thereof. The substrate layer 2 may be from about 2 mils to about 12 mils thick, depending on a desired end application for the print media.

The ink-receiving layer 6 may be formed over the substrate layer 4 from a conventional porous or a swellable coating. In one embodiment, the ink-receiving layer 6 is a conventional porous coating. For example, the ink-receiving layer 6 may be formed from microporous, inorganic particles bound in a polymer binder. The microporous, inorganic particles may include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudoboehmite, bentonite, hectorite, clay, and mixtures thereof. The ink-receiving layer 6 may be from approximately 1 $\mu$m to approximately 300 $\mu$m thick. Preferably, the ink-receiving layer 6 is from approximately 20 $\mu$m to approximately 50 $\mu$m thick.

The heat-sealable layer 8 may be formed over the ink-receiving layer 6 as a layer that is from about 0.5 $\mu$m to about 5 $\mu$m thick. Preferably, the heat-sealable layer 8 is from about 0.5 $\mu$m to about 3 $\mu$m thick. Most preferably, the heat-sealable layer 8 is from about 1 $\mu$m to about 3 $\mu$m thick. The heat-sealable layer 8 may include at least two components, each of which may be formed from polymer particles. The at least two components may be polymer particles having dissimilar sizes that pack to form a porous structure. As used herein, the term "porous" includes a polymeric material that has voids, capillaries, communicated holes, and/or fissures. While the examples used herein describe an embodiment having a first component and a second component, it is understood that three or more components having the properties described herein may also be used.

The polymer particles may include, but are not limited to, a latex polymer, such as a rubber latex, neoprene, a polyester latex, an ethylene-vinyl acetate copolymer emulsion, an acrylic-vinyl acetate copolymer emulsion, a vinyl acrylic terpolymer latex, an acrylic emulsion latex, a styrene-butadiene latex, or a poly(styrene) latex. The polymeric particles may form a continuous film when exposed to a sufficient temperature. The polymeric particles may be anionic, cationic, or nonionic. Anionic, cationic, and nonionic latexes are commercially available from numerous sources, such as Rohm and Haas Co. (Philadelphia, Pa.) under the Rhoplex® trademark. Preferably, the first component and second component are independently selected from an acrylate or a styrene polymer. For example, the first and second components may both be acrylate polymers, the first and second components may both be styrene polymers, or the first component may be an acrylate polymer and the second component may be a styrene polymer. Furthermore, the first and second component may each have the same charge. For instance, the first and second component may both be anionic, cationic, or nonionic polymers.

Each of the two components in the heat-sealable layer 8 may have a different $T_g$. For example, the first component may have a first $T_g$ while the second component may have a second $T_g$. To prevent the print media from prematurely sealing or coalescing (i.e., before the desired image is printed), the $T_g$ of each of the two components may be higher than a maximum temperature to which the print media may be exposed for extended periods during shipping or storage. Since shipping and storage conditions commonly reach 50° C., the $T_g$ of the first component may be approximately 60–75° C. The second component may have a $T_g$ above the $T_g$ of the first component. However, it is preferable that the $T_g$ of the second component is below approximately 90° C. so that the energy required to seal the heat-sealable layer 8 is practical and does not add additional expense to the cost of sealing the printed images. In order to provide the desired properties of the heat-sealable layer 8, the $T_g$'s of the two components will preferably differ by approximately 5–25° C. Therefore, the $T_g$ of the second component may be approximately 75–85° C. The first component, having a lower $T_g$, may provide the heat-sealable layer 8 with flexibility and the ability to seal at a low temperature. The second component, having a higher $T_g$, may provide the heat-sealable layer 8 with durability and stress release. The second component may also eliminate shrinkage caused by stresses that develop during the heat sealing process.

The first component and second component may be formed from polymer particles of different sizes, which allows for efficient packing and good cohesive properties using a minimum amount of binder. When the first component and second component are packed to form the heat-sealable layer 8, interstices or apertures may be formed between the polymer particles, allowing inkjet ink to flow through the heat-sealable layer 8. To provide optimal packing, the first component may have a particle size from approximately 80 nm to approximately 130 nm and the second component may have a particle size of from approximately 180 nm to approximately 250 nm. This efficient packing improves the pre-print durability so that the heat-sealable layer 8 is durable even when a reduced amount of binder is used.

In one embodiment, the first component has a smaller particle size and a lower $T_g$ and the second component has a large particle size and a higher $T_g$. The first component is referred to herein as a "soft component" and the second component as a "hard component." If anionic latexes are used in the heat-sealable layer 8, the soft component may be an anionic, 100 nm, acrylic latex having a $T_g$ of 60° C.±5° C., which is available from Rohm and Haas Co. (Philadelphia, Pa.) as part number SAC872C. The hard component may be an anionic, acrylic latex having a 200–230 nm particle size and a $T_g$ of 85° C.±5° C. This hard component is available from Rohm and Haas Co. (Philadelphia, Pa.) as part number SAC864. If cationic latexes are used, the soft component is a cationic, 100 nm, acrylic latex having a $T_g$ of 70° C.±5° C., which is available from Rohm and Haas Co. (Philadelphia, Pa.) as part number SAC889B. The hard component may be a cationic, acrylic latex having a 200–230 nm particle size and a $T_g$ of 85° C.±5° C. The hard component is available from Rohm and Haas Co. (Philadelphia, Pa.) as part number SAC883C. These acrylic latex products are available as dispersions. In one embodiment, the heat-sealable layer 8 uses 90% of an acrylic latex formulation that includes the soft and hard components with 10% binder, such as polyvinyl alcohol or polyurethane. The acrylic latex formulation includes 80% of the soft component and 20% of the hard component.

At a temperature below the $T_g$ of the first and second components, the polymer particles are discrete, spherical particles. At a temperature above the $T_g$ of the first component, but below the $T_g$ of the second component, the polymer particles of the first component may begin to flow and coalesce. At a temperature above the $T_g$ of the second component, the polymer particles of the second component may begin to flow and coalesce, forming a continuous film of the heat-sealable layer 8.

Figure 2A:
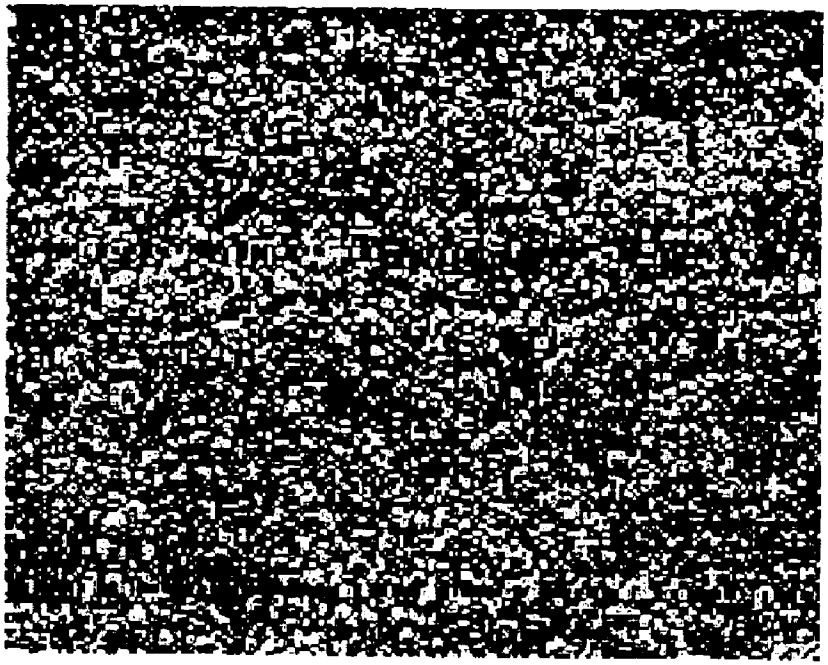
FIGS. 2A–2H are scanning electron micrographs ("SEM") illustrating the polymer particles of the heat-sealable layer according to an embodiment of the present invention.
Figure 2B:
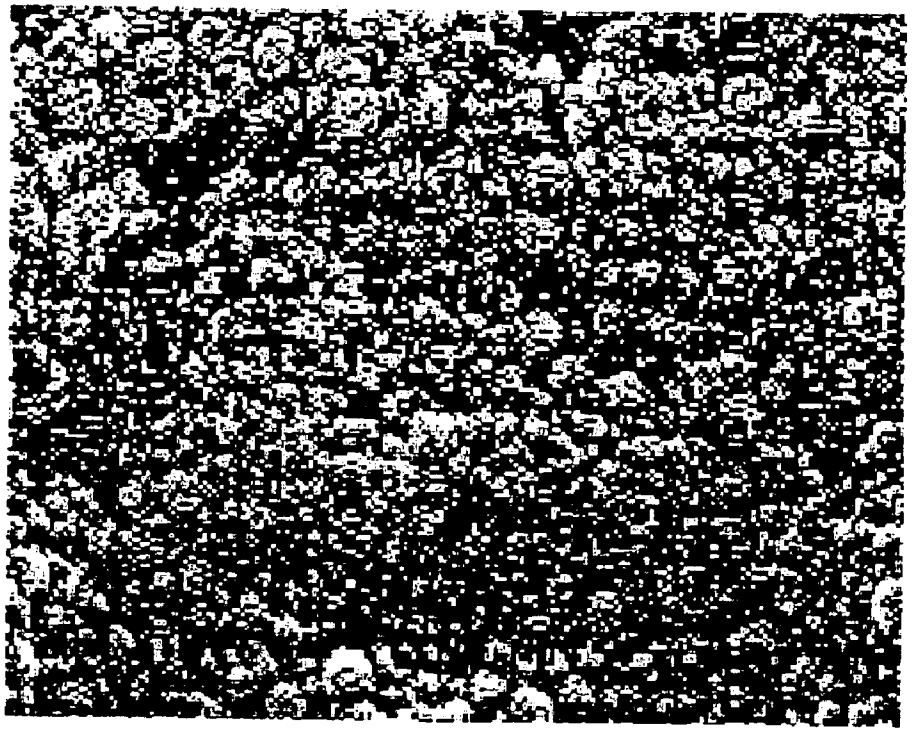
Figure 2C:
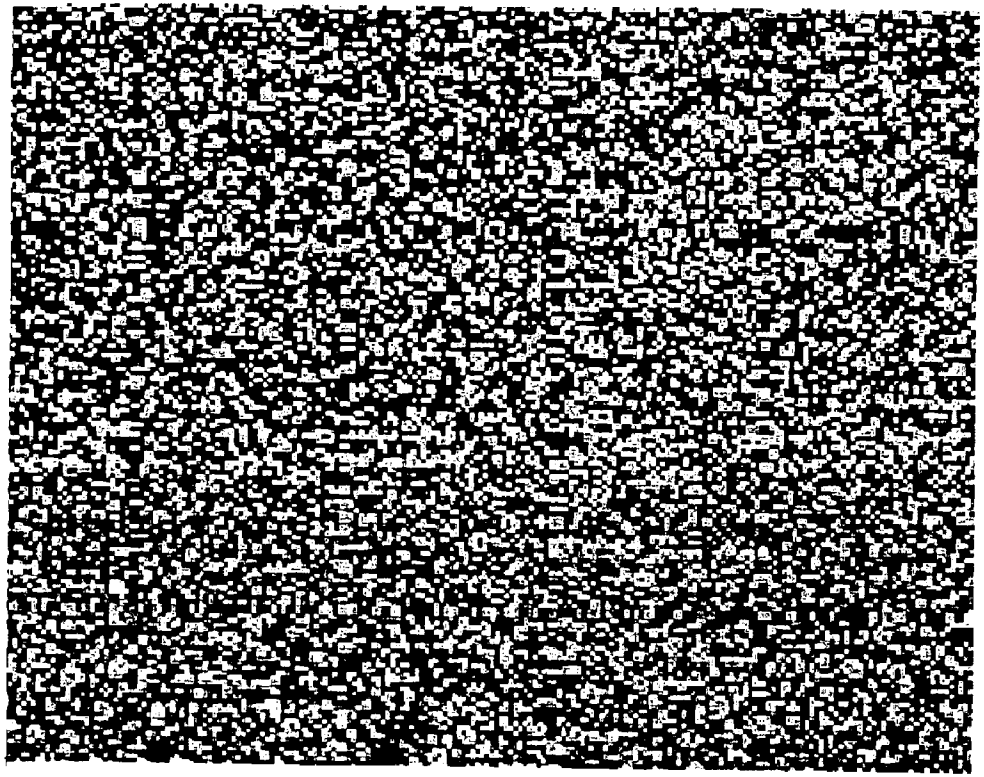
Figure 2D:
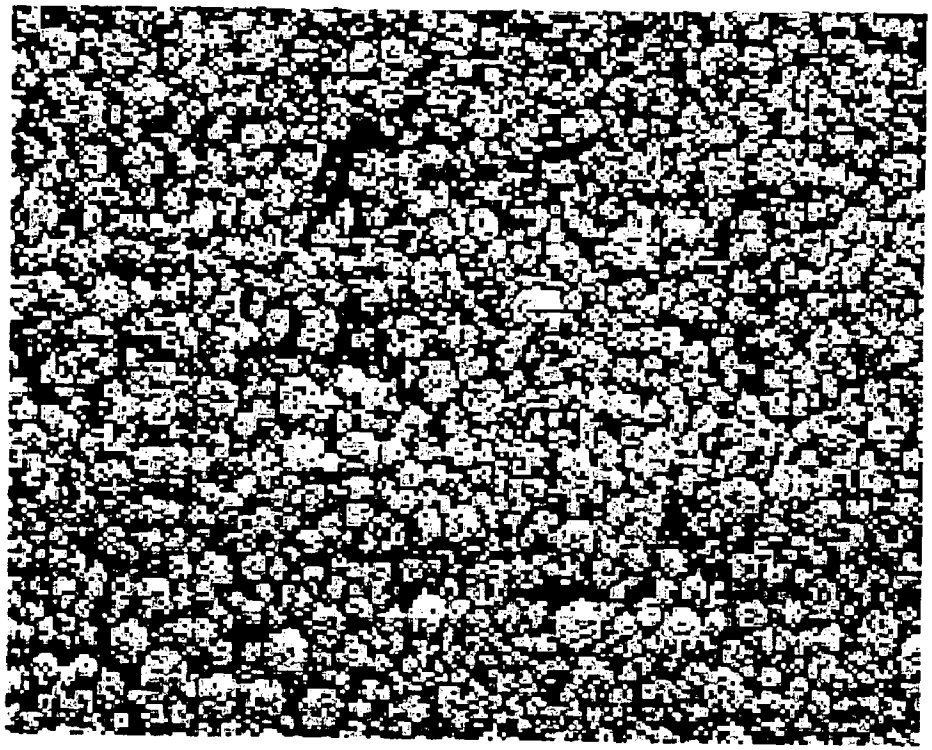
Figure 2E:
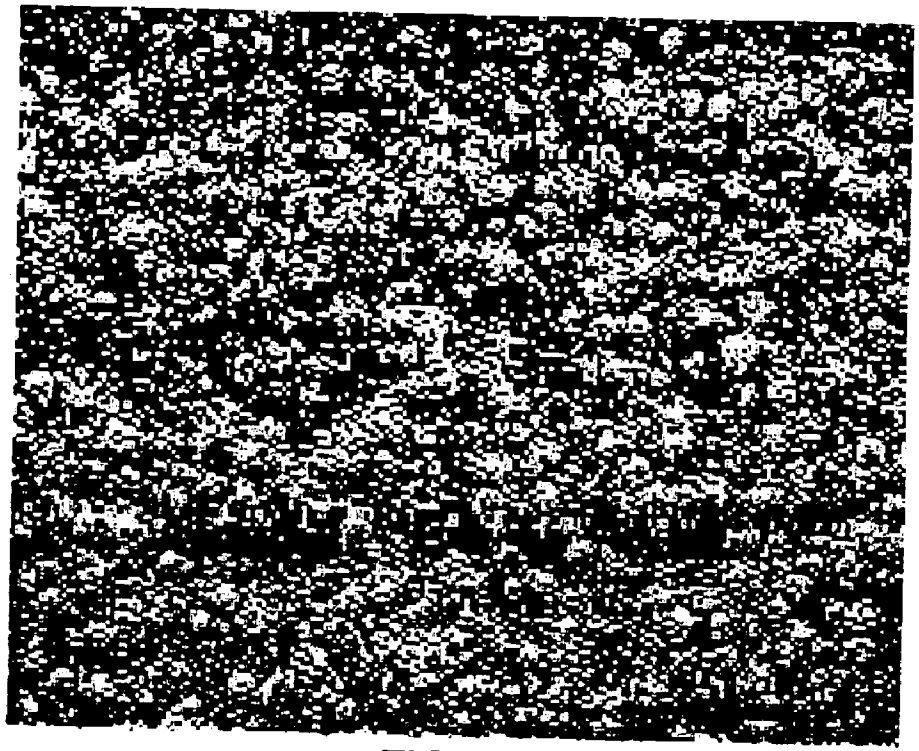
Figure 2F:
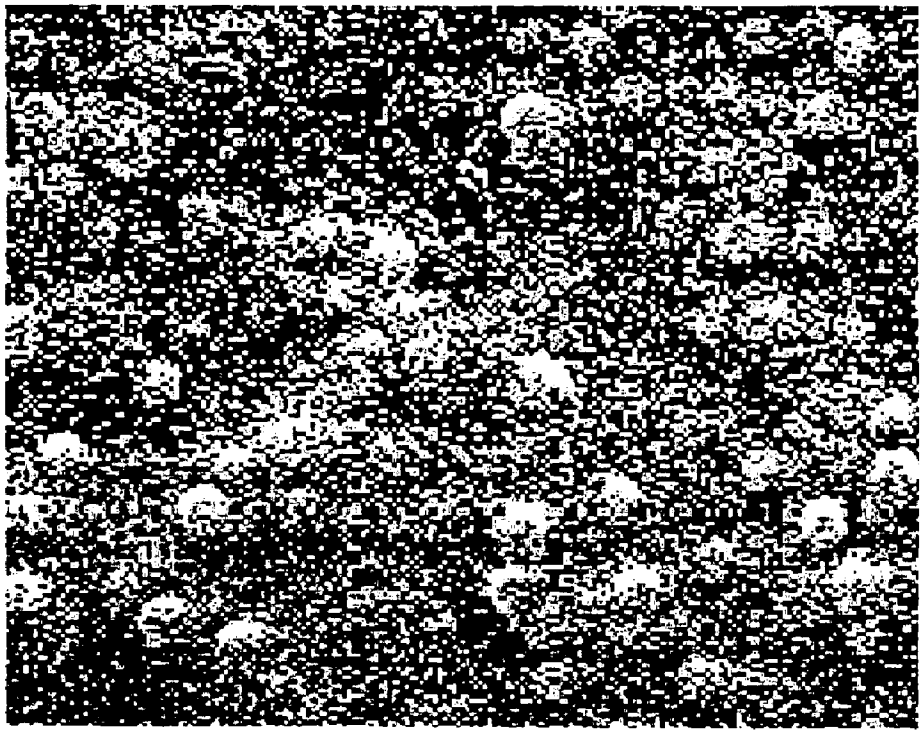
Figure 2G:
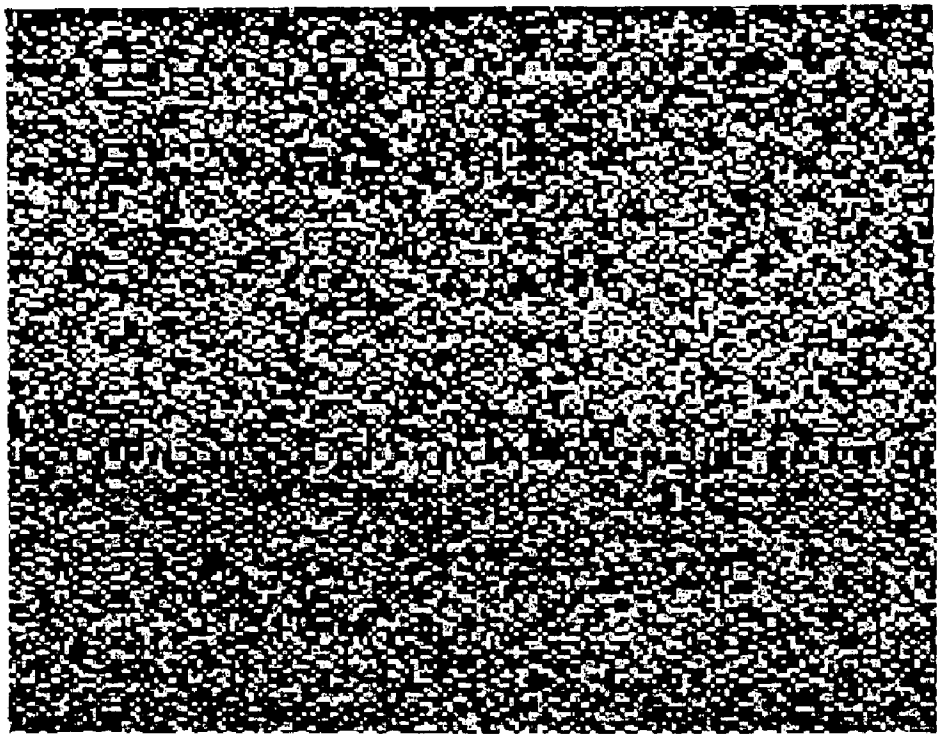
Figure 2H:
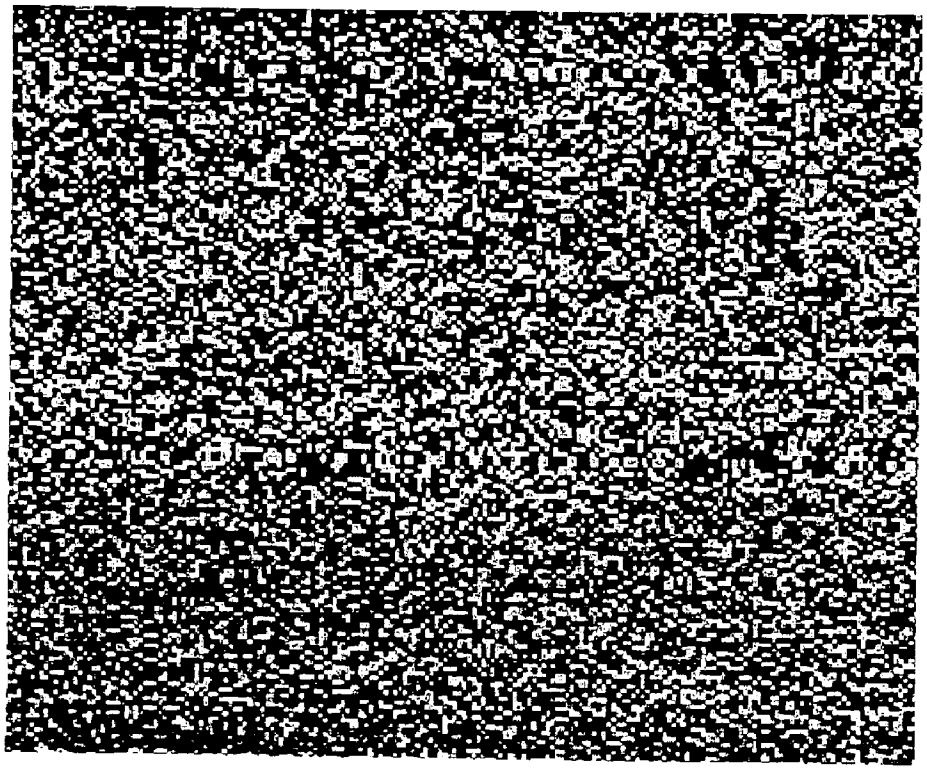

The polymeric particles of the heat-sealable layer 8 are shown in FIGS. 2A–H. In FIGS. 2A and 2B, the first component and the second component of the heat-sealable layer 8 are shown at a magnification of 50 K× and 100 K×, respectively. The two sizes of polymer particles are easily distinguished at the higher magnification. In FIGS. 2C and 2D, the first component and the second component are shown at a temperature of 45° C., where FIG. 2C shows the polymer particles at a magnification of 50 K× and FIG. 2D shows the polymer particles at 100 K×. At this temperature, which is below the $T_g$ of both components, very little coalescing or melting is observed. However, at 70° C., the first component has melted while the polymer particles of the second component remain discrete, spherical particles, as shown in FIGS. 2E and 2F. At 85° C., shown in FIGS. 2G and 2H, the polymer particles of the second component have also melted. When the first and second components are both melted, a nonporous, continuous film is formed over the ink-receiving layer 6, which seals the print media and protects the underlying layers.

In addition to the first and second components, the heat-sealable layer 8 may also include a minimal amount of a binder. The binder may be a water-soluble or water-dispersible polymer including, but not limited to, vinyl acetate homo- or co-polymers, acrylate (co)polymers, styrene/butadiene copolymers, ethylene or vinyl chloride copolymers, polyurethane dispersions, polyvinyl alcohol or derivatives thereof, polyvinylpyrrolidone, starch or derivatives thereof, gelatin or derivatives thereof, cellulose or derivatives thereof (such as cellulose ethers, carboxymethyl cellulose, hydroxyethyl cellulose, or hydroxypropylmethyl cellulose), maleic anhydride polymers or copolymers thereof, acrylic ester copolymers, polyacrylamide, casein, and water- or ammonia-soluble polyacrylates or polymethacrylates and copolymers thereof. In addition, mixtures of these polymer binders may be used.

The heat-sealable layer 8 may optionally include surfactants, pH adjusting agents, thickeners, dispersing agents, and/or lubricants depending on the desired end application of the print media.

To produce the print media, coating formulations of the ink-receiving layer 6 and the heat-sealable layer 8 may be formed by mixing the components of each layer with agitation, as known in the art. Each of the coating formulations may be diluted and applied to the substrate layer 2 or other porous underlying layers using conventional coating techniques. For example, the coating formulations may be applied using a roll coater, air knife coater, blade coater, bar coater, gravure coater, rod coater, curtain coater, die coater, or air brush. Each of the layers may be formed separately or simultaneously on the print media, as known in the art.

For example, if anionic latexes are used in the heat-sealable layer, the coating formulations may be applied as a two-pass coating. However, if cationic latexes are used, the coating formulations for the ink-receiving layer 6 and the heat-sealable layer 8 may be applied at the same time, in a one-pass coating. The coating formulations may be dried at a temperature below the $T_g$ of the soft component of the heat-sealable layer 8 so that the heat-sealable layer 8 is not prematurely sealed.

Figure 1B:
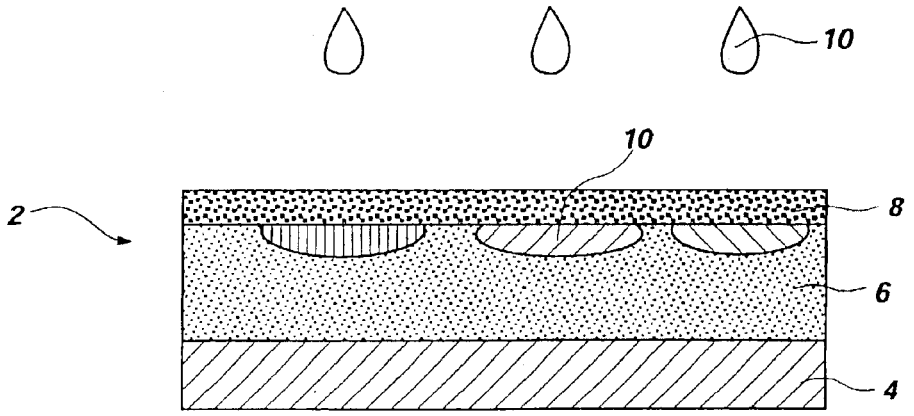
Figure 1C:
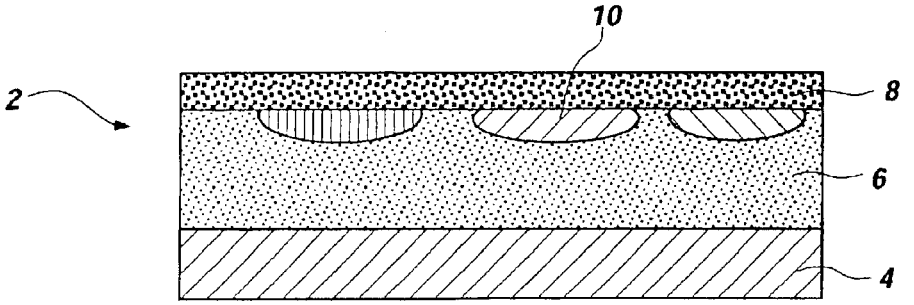

The print media may be used in an inkjet printing process to print photographic-quality images. As shown in FIG. 1B, the inkjet ink 10 may be applied to the print media. The inkjet ink 10, which may be a black or colored dye-based inkjet ink, penetrates the heat-sealable layer 8 and travels into the ink-receiving layer 6 to produce the desired printed image. Since the ink-receiving layer 6 may be a porous coating, the print media has a fast dry time. The resulting printed image has good print quality, even before the heat-sealable layer 8 is sealed. However, the print quality may be dramatically improved by sealing the heat-sealable layer 8. As shown in FIG. 1C, the print media may be sealed by exposing the print media to a temperature slightly higher than the $T_g$ of the first and second components. At this temperature, both components of the heat-sealable layer 8 melt to form the continuous, nonporous layer that generally seals the print media, including the ink-receiving layer with inkjet ink 10 contained therein or thereon. For example, the print medium may be exposed to a temperature slightly higher than the $T_g$ of the hard component. The sealed print media will exhibit increased durability, waterfastness, scratch resistance, and/or image quality.

The energy or heat required to seal the heat-sealable layer 8 may be produced by any heat source, such as a drying oven, an infrared ("IR") oven, a heat lamp, an IR lamp, a convective heater, or a contact-type heater. Preferably, the heat source is incorporated into an ink-jet printer, as described in more detail below. It is also contemplated that the heat-sealable layer 8 may be sealed using a combination of heat and pressure, such as by using a hot press, a laminator, or an iron.

While anionic or cationic latexes may be used in the heat-sealable layer 8, the selection of latex may affect the color gamut and airfade resistance of the printed image. If the polymer particles used in the heat-sealable layer 8 are anionic, the dye in the inkjet ink 10 may penetrate further into the ink-receiving layer 6. While this printed image may have good fade resistance because the dye is further from the surface of the print media, the color gamut may be decreased. In contrast, if the polymer particles used in the heat-sealable layer 8 are cationic, the dye may remain at the surface of the ink-receiving layer 6 or even remain in the heat-sealable layer 8, which could increase the color gamut.

The inkjet ink 10 used to print the image may be a conventional dye-based inkjet ink. The inkjet ink 10 may optionally include surfactants, pH adjusting agents, biocides, and/or other conventional additives, depending on the desired properties of the inkjet ink 10.

Figure 3:
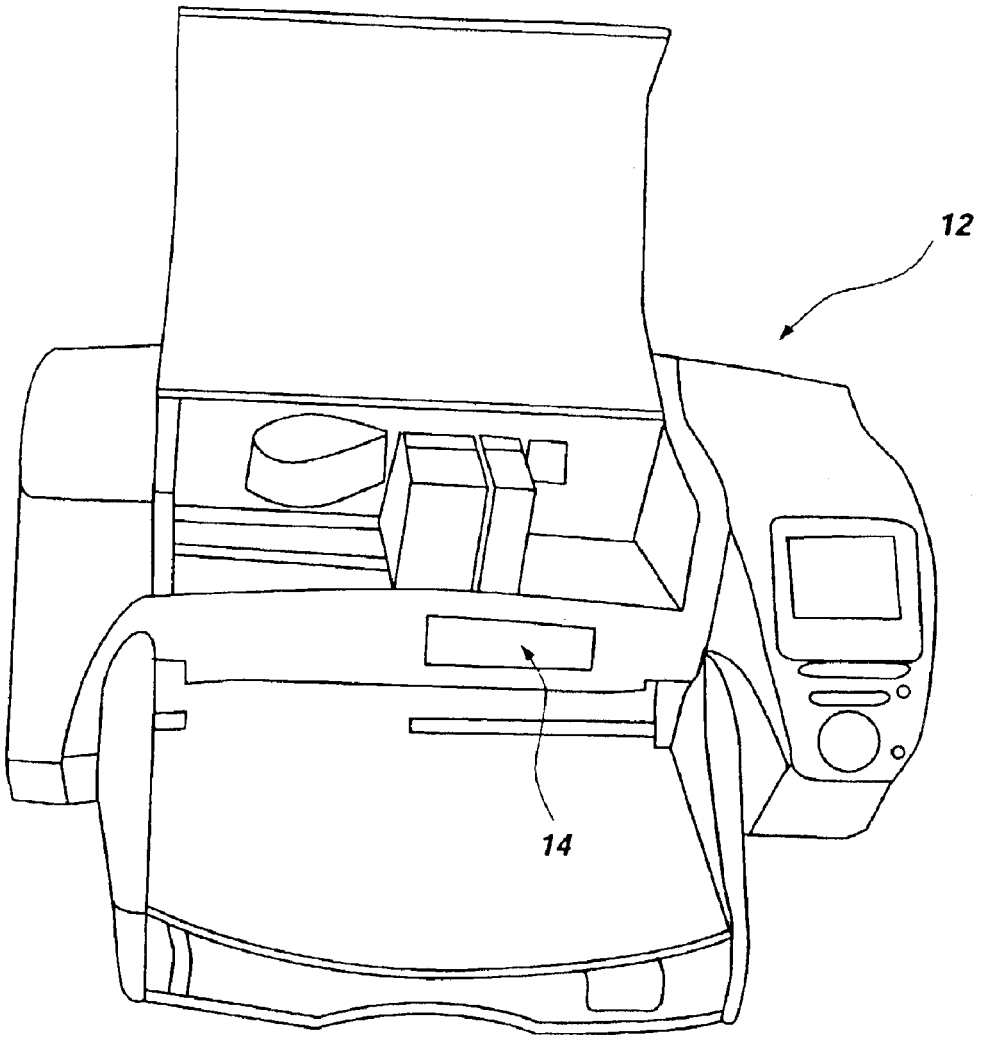
FIG. 3 illustrates an embodiment of an inkjet printer used in the inkjet printing process.

The inkjet printer 12 used to apply the inkjet ink 10 may include a radiant heater 14, as shown in FIG. 3. The radiant heater 14 may be a fuser, such as a light bulb or an IR heater that produces the necessary energy to seal the heat-sealable layer 8. The print media may be sealed by exposing the heat-sealable layer 8 to an indirect heat. In other words, the radiant heater 14 does not contact the print media. Rather, the radiant heater 14 is positioned a distance away from the print media and the heat generated by the radiant heater 14 may be sufficient to cause the polymer particles of the heat-sealable layer to melt. Preferably, the radiant heater 14 is positioned approximately 1 inch away from the print media.

The print media of the present invention provides good durability before sealing and very high durability after sealing. The print medium also provides good image quality before and after sealing. This is in stark contrast to conventional sealable print media that only exhibit good image quality after sealing. Advantageously, a user of the print medium does not need to purchase extra supplies in order to achieve the improved properties of the print media. The print media can be sealed using a low cost, radiant heater instead of a laminator that has moving parts and accessories. Since the print media provides good image quality both before and after sealing, the user is given the option of sealing. In other words, the user would still achieve good image quality even if he or she chose not to seal the print media. The user may also use the print media with a conventional inkjet printer (one lacking a radiant heater 14) to achieve photographic-quality images. The user is therefore not required to purchase the inkjet printer 12 described above to achieve photographic-quality images. In addition, the user may achieve the photographic-quality images by sealing the print media using a heat source external to the inkjet printer, such as a drying oven or a heat lamp.

The print media having two components in its heat-sealable layer 8 is advantageous over sealable print media that only use a single polymer material having a small particle size and a high $T_g$ because these single component print media require a high temperature to seal the layer. Since the single component print media require a higher sealing temperature, the heat source must be capable of generating more energy, which adds to the overall cost of the printer. In addition, the preprint durability is reduced. Single component print media using a low $T_g$ polymer material are also not optimal because they exhibit shrinkage at high temperatures. However, by combining the hard and soft components, as described in the present invention, a heat-sealable print media having good image quality, permanence, and resistance to airfade is achieved. In addition, the print media does not exhibit cracking.

EXAMPLES

Example 1

Formulation of Cationic Heat-Sealable Layer

A cationic acrylate coating formulation was prepared by mixing 65 parts by weight of the 100 nm cationic acrylic dispersion, 25 parts by weight of the 200–230 nm cationic acrylic dispersion, and 10 parts binder. Both of the cationic acrylic dispersions were manufactured by Rohm and Haas. The binder was one of the following: NEOREZ® 9330 (a nonionic polyurethane dispersion available from NeoResins (Wilmington, Mass.)), IJ-60 (a cationic polyurethane dispersion available from Esprit), Goshefimer OKS6012 (a modified polyvinyl alcohol available from Nippon Goshei (Osaka, Japan)) or Goshefimer OKS6011 (a modified polyvinyl alcohol available from Nippon Goshei (Osaka, Japan)).

The cationic acrylate coating formulation was applied over a conventional substrate layer 4 and a conventional microporous alumina coating used as the ink-receiving layer 6 to form the print media. The coating weight of the cationic acrylate coating, when dried, was about 1.5 grams per square meter ("gsm"). The cationic acrylate coating formulation was dried to form the heat-sealable layer 8.

Example 2

Formulation of Anionic Heat-Sealable Layer

An anionic acrylate coating formulation was prepared by mixing 65 parts by weight of the 100 nm anionic acrylic dispersion, 25 parts of the 200–230 nm anionic acrylic dispersion, and 10 parts of a polyvinyl alcohol binder. Both of the anionic acrylic dispersions were manufactured by Rohm and Haas The anionic acrylate coating formulation was applied over a conventional substrate layer 4 and a conventional microporous alumina coating used as the ink-receiving layer 6 to form the print media. The coating weight of the anionic acrylate coating, when dried, was about 1.5 gsm. The anionic acrylate coating formulation was dried to form the heat-sealable layer 8.

Example 3

Performance Results of the Cationic Heat-Sealable Layer

The print media having the cationic heat-sealable layer 8 described in Example 1 was tested for airfade, gamut, humid fastness, preseal durability, postseal durability, and gloss. For ease of reference, these print media 2 are hereafter referred to as "two component cationic print medium." These properties were tested by applying a conventional dye-based inkjet ink, such as that used in a Hewlett-Packard Deskjet 970 C printer, to the heat-sealable layer 8 using an inkjet printer similar to that shown in FIG. 3. The inkjet printer included a 22V, 45W radiant heater (having a hot nichrome wire encased in a glass bulb) that was manufactured by Osram Sylvania (Danvers, Mass.). After the desired image was printed, the radiant heater 14 was used to seal the heat-sealable layer 8.

A control print medium lacking the heat-sealable layer 8 was also prepared and tested. The control print medium included the ink receptive layer 6 over the substrate layer 4. In addition, a print medium having a single, acrylic latex component in the heat-sealable layer 8 was tested. The single component print medium included 80% of the 100 nm acrylic and 20% NEOREZ® 9330.

The gamut, airfade, humid fastness, preseal durability, postseal durability, and gloss were measured by conventional techniques. The gamut was measured by CIE Lab techniques. The airfade was measured for four weeks with air blowing past the printed image at approximately 300–400 ft/min. The humid fastness was measured at 30° C. and 80% relative humidity for four days. Postseal durability was measured by a qualitative scratch test. Gloss was measured with a Gardner gloss meter.

As shown in Table 1 and FIG. 4, the two component cationic print media 2 exhibited improved gamut compared to the control print medium, which lacked the heat-sealable layer 8. These two component cationic print media 2 also showed comparable or improved gamut compared to the single component print medium.

TABLE 1

Performance Results of the Cationic Heat-Sealable Layer

| Formulation | Gamut | Airfade % C/M/Y (4 weeks) | Humid fastness (Max line broadening) | Preseal Durability | Postseal Durability | 20° C. Unprinted Gloss | Max Printed Gloss |
|---|---|---|---|---|---|---|---|
| Control | 366644 | 29/44/13 | | Good | Good | 37 | 40 |
| 100 nm Acrylic Neorez 9330 | 416780 | 1.4/2.4/0.9 | Comparable to Control | fair | High | 33 | 46 |
| 100 nm Acrylic 230 nm Acrylic Neorez 9330 | 418540 | 0.4/2/0.9 | Comparable to Control | fair | High | 25 | 29 |
| 100 nm Acrylic 230 nm Acrylic IJ-60 | 428856 | 0.6/1.8/0.6 | Comparable to Control | fair | High | 31 | 35 |
| 100 nm Acrylic 230 nm Acrylic OKS6012 | 404009 | 0.2/1.4/3.0 | Comparable to Control | fair | High | 32 | 36 |
| 100 nm Acrylic 230 nm Acrylic OKS6012(X-linked) | 417732 | 1.2/1.4/0.4 | Comparable to Control | fair | High | 39 | 42 |
| 100 nm Acrylic 230 nm Acrylic OKS6011 | 408143 | 1.1/1.6/0.6 | Comparable to Control | | | 39 | 47 |
| 100 nm Acrylic 230 nm Acrylic OKS6011(X-linked) | 396587 | 1.5/1.6/0.4 | Comparable to Control | | | 41 | 44 |

As shown in Table 1 and FIG. 5, the two component cationic print media 2 also exhibited drastically improved airfade compared to the control print medium, and exhibited comparable or improved airfade in relation to the single component print medium. It was also observed that the amount of airfade before sealing the two component cationic print media was comparable to the airfade when no heat-sealable layer 8 was present on the print medium. However, after sealing, the airfade was dramatically improved.

Referring again to Table 1, the two component cationic print media 2 also showed comparable humid fastness compared to the control print medium. The two component cationic print media 2 exhibited fair preseal durability compared to the control print medium, while the postseal durability was dramatically improved. It was also observed that before the print medium was sealed, durability was slightly worse than the durability of a print medium having no heat-sealable layer 8. However, after the print medium was sealed, the durability was improved.

Many of the two component cationic print media 2 also exhibited comparable or improved gloss to the control print medium. As shown in FIG. 6, the formulations having the 100 nm acrylic latex, the 200 nm acrylic latex, and OKS6011 or OKS6012 as the binder showed comparable or improved 20° C. unprinted gloss. FIG. 7 shows that the maximum printed gloss of these same formulations was approximately the same or improved compared to that of the control print medium.

Example 4

Performance Results of Anionic Formulations

The print media having the anionic heat-sealable layer 8 described in Example 2 was tested for airfade, gamut, humid fastness, preseal durability, postseal durability, and gloss. These properties were tested by applying a conventional dye-based inkjet ink, such as that used in a Hewlett-Packard Deskjet 970C printer, to the heat-sealable layer 8 using an inkjet printer similar to that shown in FIG. 3. The inkjet printer included a 22V, 45W radiant heater (having a hot nichrome wire encased in a glass bulb) that was manufactured by Osram Sylvania. After the desired image was printed, the radiant heater 14 was used to seal the heat-sealable layer 8.

A control print medium lacking the heat-sealable layer 8 was also prepared and tested. The control print medium included the ink receptive layer 6 over the substrate layer 4. In addition, a print medium having a single, acrylic latex component in the heat-sealable layer 8 was tested. The single component print medium included 80% of the 100 nm acrylic and 20% NEOREZ® 9330.

The gamut, airfade, humid fastness, preseal durability, postseal durability, and gloss were measured by conventional techniques, as previously described.

The two component, anionic print media 2 showed improved gamut, humid fastness, preseal durability, postseal durability, and gloss, similar to the results obtained with the two component, cationic print media 2.

What is claimed is:

1. A print medium for use in an inkjet printing process, comprising:

a substrate layer; and a heat-sealable layer over the substrate layer, said heat-sealable layer having a first component and a second component, wherein the first component has a first glass transition temperature and a first particle size and the second component has a second glass transition temperature and a second particle size, wherein the first glass transition temperature and the second glass transition temperature differ by approximately 5–25° C.

2. The print medium of claim 1, wherein the first component and the second component are independently selected from an acrylate polymer or a styrene polymer.

3. The print medium of claim 1, wherein the first component has a glass transition temperature of between approximately 60–75° C. and the second component has a glass transition temperature of between approximately 75–85° C.

4. The print medium of claim 1, wherein the first component has a particle size of between approximately 80–130 nm and the second component has a particle size of between approximately 180–250 nm.

5. The print medium of claim 1, wherein the first component is an acrylic latex present at approximately 65 parts, the second component is an acrylic latex present at approximately 25 parts, and a binder is present at approximately 10 parts.

6. A print medium for use in an inkjet printing process, comprising:

a substrate layer; and a heat-sealable layer over the substrate layer, said heat-sealable layer having a first component and a second component, wherein the first component has a first glass transition temperature and a first particle size and the second component has a second glass transition temperature and a second particle size, wherein the first component has a glass transition temperature of between approximately 60–75° C. and the second component has a glass transition temperature of between approximately 75–85° C.

7. The print medium of claim 6, wherein the first component and the second component are independently selected from an acrylate polymer or a styrene polymer.

8. The print medium of claim 6, wherein the first component has a particle size of between approximately 80–130 nm and the second component has a particle size of between approximately 180–250 nm.

9. The print medium of claim 6, wherein the first component is an acrylic latex present at approximately 65 parts, the second component is an acrylic latex present at approximately 25 parts, and a binder is present at approximately 10 parts.

10. A print medium for use in an inkjet printing process, comprising:

a substrate layer; and a heat-sealable layer over the substrate layer, said heat-sealable layer having a first component and a second component, wherein the first component has a particle size of between approximately 80–130 nm and the second component has a particle size of between approximately 180–250 nm.

11. The print medium of claim 10, wherein the first component and the second component are independently selected from an acrylate polymer or a styrene polymer.

12. The print medium of claim 10, wherein the first component is an acrylic latex present at approximately 65 parts, the second component is an acrylic latex present at approximately 25 parts, and a binder is present at approximately 10 parts.

* * * * *